US010183778B2

(12) United States Patent
Keefe, Jr.

(10) Patent No.: US 10,183,778 B2
(45) Date of Patent: Jan. 22, 2019

(54) WRAPAROUND CLAMSHELL DISPLAY

(71) Applicant: INTERNATIONAL PAPER COMPANY, Memphis, TN (US)

(72) Inventor: Walter D. Keefe, Jr., Carol Stream, IL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 15/491,015

(22) Filed: Apr. 19, 2017

(65) Prior Publication Data

US 2018/0305069 A1 Oct. 25, 2018

(51) Int. Cl.

| | |
|---|---|
| ***B65D 5/52*** | (2006.01) |
| ***B65D 5/54*** | (2006.01) |
| ***B65D 5/42*** | (2006.01) |
| ***B65D 5/02*** | (2006.01) |

(52) U.S. Cl.

CPC ..... *B65D 5/52* (2013.01); *B65D 5/0227* (2013.01); *B65D 5/4266* (2013.01); *B65D 5/54* (2013.01)

(58) Field of Classification Search

CPC ..... B65D 5/0227; B65D 5/5445; B65D 5/52

USPC ..... 220/738, 774, 235; 206/45.21, 467, 469

See application file for complete search history.

(56) References Cited

U.S. PATENT DOCUMENTS

| | | | | |
|---|---|---|---|---|
| 6,981,632 | B2 | 1/2006 | Gardner et al. | |
| 9,187,207 | B2 | 11/2015 | Gessler, Jr. et al. | |
| 9,555,919 | B2 | 1/2017 | Gessler, Jr. et al. | |
| 2005/0184139 | A1* | 8/2005 | Gasior | B65D 5/0227 229/240 |
| 2017/0096252 | A1 | 4/2017 | Gessler, Jr. et al. | |

* cited by examiner

*Primary Examiner* — King M Chu

(74) *Attorney, Agent, or Firm* — Thomas W. Ryan; Michael D. Folkerts

(57) ABSTRACT

A shipping container convertible to a display container formed from a one-piece blank of sheet material. The container comprises an inner front panel, a bottom panel, a back panel, a top panel, and an outer front panel connected in series at respective first, second, third, and fourth fold lines. Inner front side flaps joined to the inner front panel and back side flaps joined to the back panel extend along lateral sides of the container. Bottom side flaps joined to the bottom panel overlap the inner front side flaps and the back side flaps. Top side flaps joined to the top panel overlap an outer surface of at least the back side flaps. Outer front side flaps joined to the outer front panel overlap outer surfaces of the top side flaps and the bottom side flaps.

20 Claims, 5 Drawing Sheets

WRAPAROUND CLAMSHELL DISPLAY

FIELD OF THE INVENTION

This invention relates generally to containers for shipping products to points of sale. More particularly, the invention is a shipping container that is convertible to a display container at the point of sale.

BACKGROUND OF THE INVENTION

It is common practice to load a quantity of individual packages of consumer products into corrugated paperboard shipping containers for bulk shipment of the packages to a point of sale. At the point of sale, the individual packages may be removed from the shipping container and placed on a shelf for display and sale to the consumer.

In some instances, the product packages may be left in the shipping container which then also serves to support and display the packages for sale. If the shipping container is a conventional box, then the retailer must cut away a portion of the box in order to expose the product packages and provide access to them by the consumers. In order to provide a more attractive display and facilitate ease of use by the retailer, combination of shipping and display containers have been developed which have one or more sections that may be removed along weakened lines to expose the product packages and provide access to them.

SUMMARY OF THE INVENTION

In accordance with an aspect of the invention, a shipping container convertible to a display container formed from a one-piece blank of sheet material is provided. The container comprises an inner front panel, a bottom panel, a back panel, a top panel, and an outer front panel connected in series at respective first, second, third, and fourth fold lines. Inner front side flaps are foldably joined to the inner front panel and back side flaps are foldably joined to the back panel. The inner front side flaps and back side flaps extend along lateral sides of the container. Bottom side flaps are foldably joined to the bottom panel and overlap outer surfaces of the inner front side flaps and the back side flaps. Top side flaps are foldably joined to the top panel and overlap an outer surface of at least the back side flaps. Outer front side flaps are foldably joined to the outer front panel and overlap outer surfaces of the top side flaps and the bottom side flaps.

A joint may be formed adhering at least one of the bottom side flaps to at least one of the back side flaps wherein the top side flaps are not adhered to the back side flaps.

A joint may be formed adhering at least one of the outer front side flaps to at least one of the top side flaps wherein the outer front side flaps are not adhered to the bottom side flaps.

The third fold line between the top panel and the back panel may comprise a separation line.

At least one of the inner front panel and the outer front panel may include a separable panel portion defined by a pair of spaced separation lines extending from a lower front edge of the container.

One of the inner and outer front panels may include an opening having opposed lateral ends and the separation lines may extend from the opposed lateral ends of the opening.

A belly band may extend between the separation lines across a portion the inner front panel and may include a joint adhering the outer front panel to the belly band.

In accordance with another aspect of the invention, a one-piece blank of sheet material for forming a shipping container convertible to a display container is provided. The blank comprises an inner front panel, a bottom panel, a back panel, a top panel, and an outer front panel connected in series at respective first, second, third, and fourth fold lines. Inner front side flaps are foldably joined to the inner front panel, back side flaps are foldably joined to the back panel, bottom side flaps are foldably joined to the bottom panel, top side flaps are foldably joined to the top panel, and outer front side flaps are foldably joined to the outer front panel. A first one of the inner and outer front panels define a first longitudinal end of the blank and includes an opening having opposed lateral ends, and a second one of the inner and outer front panels includes a recess cut into the second one of the inner and outer panels from a second longitudinal end of the blank.

A pair of laterally spaced separation lines may extend from the lateral ends of the opening toward the first longitudinal end of the blank.

The third fold line between the top panel and the back panel may comprise a separation line.

A longitudinal length of the outer front panel may be substantially equal to a longitudinal length of the back panel.

A longitudinal length of the inner front panel may be less than the longitudinal length of the outer front panel.

In accordance with a further aspect of the invention, a method of forming a shipping container convertible to a display container from a one-piece blank of sheet material is provided. The blank comprises an inner front panel, a bottom panel, a back panel, a top panel, and an outer front panel connected in series at respective first, second, third, and fourth fold lines. The method comprises folding the inner front panel upward from the bottom panel to a generally vertical position; folding the back, top and outer front panels about the second, third and fourth fold lines; folding inner front side flaps joined to the inner front panel to extend along lateral sides of the container; folding back side flaps joined to the back panel to extend along the lateral sides of the container; folding bottom side flaps joined to the bottom panel to overlap a lower portion of the inner front side flaps and the back side flaps; folding top side flaps joined to the top panel to overlap an upper portion of at least the back side flaps; and folding outer front side flaps joined to the outer front panel to overlap front portions of the top side flaps and bottom side flaps.

A joint may be formed adhering at least one of the bottom side flaps to at least one of the back side flaps, and wherein the top side flaps are not adhered to the back side flaps.

A joint may be formed adhering at least one of the bottom side flaps to at least one of the inner front side flaps.

A joint may be formed adhering at least one of the outer front side flaps to at least one of the top side flaps, and wherein the outer front side flaps are not adhered to the bottom side flaps.

A joint may be formed adhering the outer front panel to at least one of the inner front panel and the bottom panel.

A pair of laterally spaced separation lines may be provided on at least one of the inner front panel and the outer front panel, and the container may be converted to a display container by separating a portion of the at least one panel along the separation lines.

The portion of the at least one panel may comprise a portion of the inner front panel that is adhered to an inner surface of the outer front panel, and wherein the portion of the inner panel may remain adhered to the outer front panel when the portion of the inner front panel is separated along the separation lines.

The third fold line between the top panel and the back panel may comprise a separation line, and converting the container to a display container may include separating the top panel from the back panel along the third fold line.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction comprising a one-piece wraparound blank that is folded around a product to form a clamshell container having a lid comprising a tear-away element that can be removed to form a display case for the product. The described container can be formed from a blank processed either with equipment designed for this purpose or by hand. For example, the blank may be folded using currently available case forming equipment to form the clamshell container enclosing the product for shipping the product to a point of sale, or the container can be formed around the product through manually executed steps, or through a combination of machine implemented and manual steps.

Figure 1:
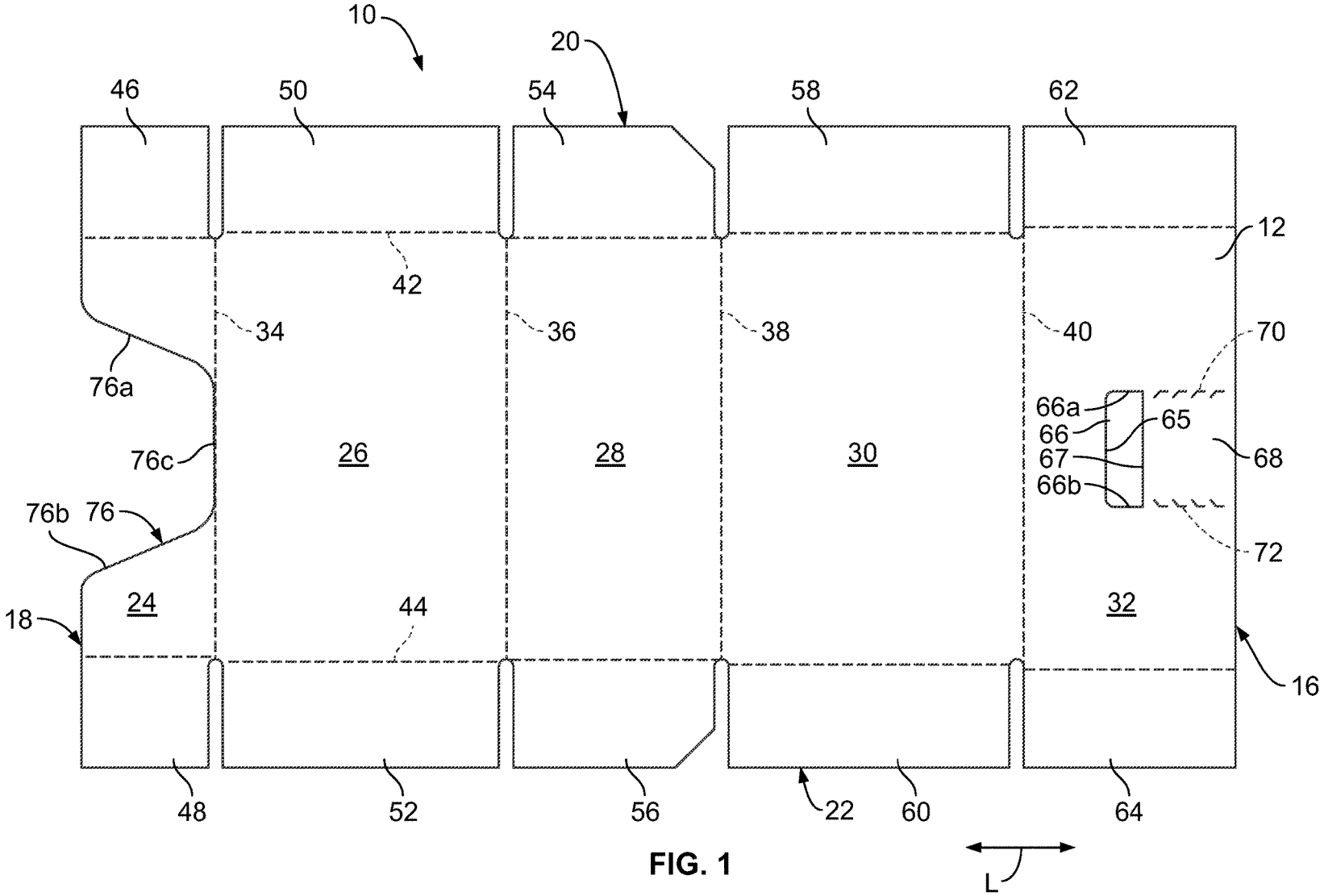
FIG. 1 is a plan view of a blank for forming a container.
Figure 5:
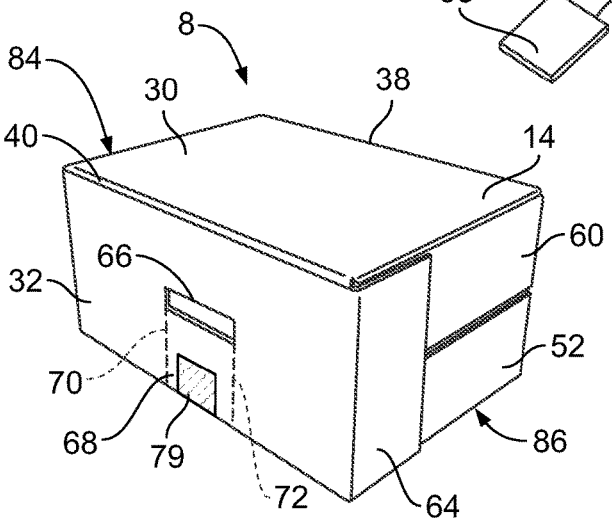
FIG. 5 is a perspective view illustrating completion of the wraparound folding operation to form a shipping container.

Referring to FIG. 1, a die cut blank 10 is shown for illustrating one or more aspects of the container described herein. In a use of the blank to form a one-piece container 8, see FIG. 5, the blank 10 may be formed of a corrugated cardboard material and may be die cut to the shape shown herein, although other materials and variations of the illustrated shape may be provided within the scope of the container described and claimed herein. The blank 10 illustrated in FIG. 1 is a planar piece of material in which an inner side 12 is shown facing out of the page and an outer side 14, see FIG. 5, is facing an opposite direction from the inner side 12.

As seen in FIG. 1, the blank 10 extends in a longitudinal direction L between first and second longitudinal ends, generally designated 16 and 18, respectively, and further extends in a lateral direction between first and second lateral edges, generally designated 20 and 22, respectively. The blank 10 comprises an inner front panel 24, a bottom panel 26, a back panel 28, a top panel 30, and an outer front panel 32 connected in series. The inner front panel 24 is connected to the bottom panel 26 at a first lateral fold line 34, the bottom panel 26 is connected to the back panel 28 at a second lateral fold line 36, the back panel 28 is connected to the top panel 30 at a third lateral fold line 38, and the top panel 30 is connected to the outer front panel 32 at a fourth lateral fold line 40. A longitudinal length of the outer front panel 32, extending in the longitudinal direction L, is substantially equal to a longitudinal length of the back panel 28, and a longitudinal length of the inner front panel 24 is less than the longitudinal length of the outer front panel 32.

The third fold line 38 comprises a separation line that may be defined, for example, by a partial cut through at least one layer of the corrugated material or a cut line interrupted by short sections of bridging (uncut) material. As will be further understood from the description below, the separation line defined at the third fold line 38 forms a structurally weakened line that can permit separation of the top panel 30 from the back panel 28.

The outer front panel 32 includes an elongated opening 66 located intermediate the fourth fold line 40 and the first longitudinal end 16. The opening 66 is defined by longitudinally spaced edges 65, 67 connected by opposed laterally spaced edges or ends 66*a*, 66*b*. A separable panel portion 68 is defined between two laterally spaced separation lines 70, 72 that extend from the lateral ends 66*a*, 66*b* of the opening 66 toward the first longitudinal end 16 of the blank 10. The separation lines 70, 72 may be defined, for example, by a partial cut through at least one layer of the corrugated material or a cut line interrupted by short sections of bridging (uncut) material. The separation lines 70, 72 permit separation of the separable panel portion 68 from the outer front panel 32, as described further below.

The second longitudinal end 18 of the blank comprises a recess 76 cut into the inner front panel 24 from the second longitudinal end 18 of the blank 18. In particular, the recess 76 is defined by lateral edges 76*a*, 76*b* that angle inward toward each other from the second longitudinal end 18 toward an inner recess edge 76*c* that is generally aligned with, e.g., collinear with, the first fold line 34.

Inner front side flaps 46, 48 are foldably joined to laterally opposed sides of the inner front panel 24 along respective first and second longitudinal fold lines 42, 44. Bottom side flaps 50, 52 are foldably joined to the bottom panel 26 at the respective longitudinal fold lines 42, 44. Back side flaps 54, 56 are foldably joined to the back panel 28 at the respective longitudinal fold lines 42, 44. Top side flaps 58, 60 are foldably joined to the top panel 30 at the respective longitudinal fold lines 42, 44. Outer front side flaps 62, 64 are foldably joined to the outer front panel 32 at the respective longitudinal fold lines 42, 44.

Referring to FIGS. 2-5, a series of folding steps for performing a wraparound folding operation using the blank 10 of FIG. 1 is described for forming a shipping container 8, see FIG. 5. Although the preferred embodiments presented herein describe applying an "adhesive" forming a joint between adjacent flaps and panels, or forming a "joint adhering" adjacent flaps and panels, it should be understood that such a joint or connection between the flaps and panels can be formed by gluing or can be equivalently formed through other attachment mechanisms for connecting the flaps and panels together, and may alternatively encompass, without limitation, gluing, taping, stapling or stitching.

Figure 2:
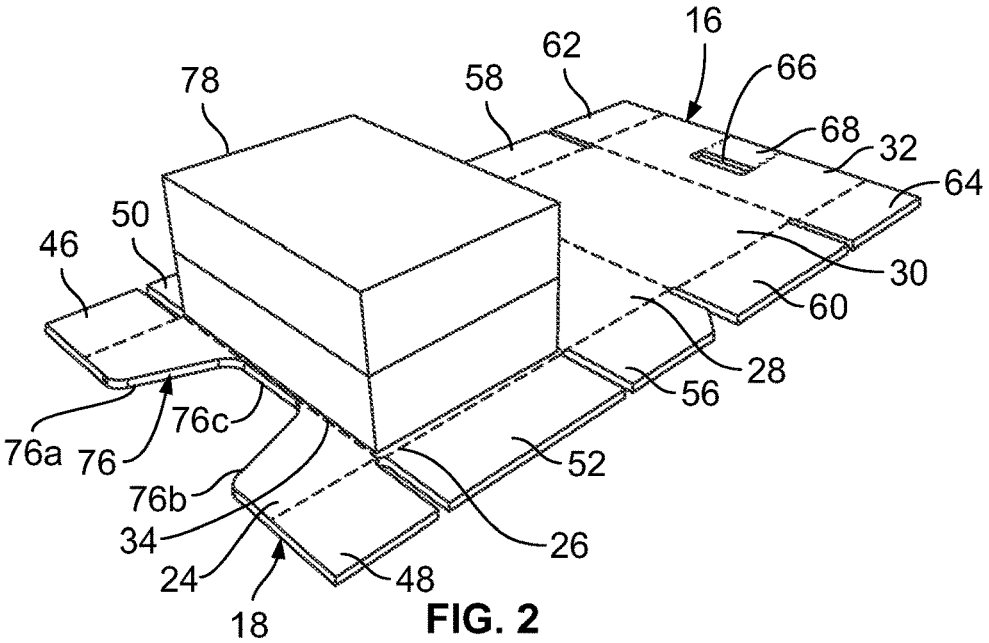
FIG. 2 is a perspective view of a product placed on the blank of FIG. 1 prior to a wraparound folding operation.
Figure 3:
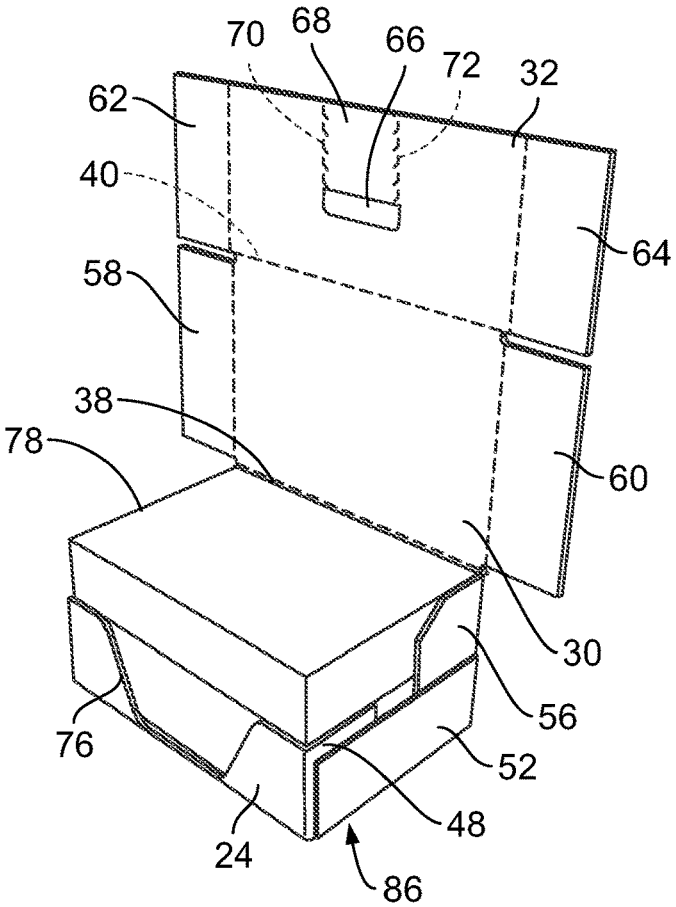
FIG. 3 is a perspective view illustrating partial completion of the wraparound folding operation following formation of a base portion of the container.

As illustrated in FIG. 2, a product 78 to be packaged in the container 8 is initially placed on the bottom panel 26 of the blank 10. The product 78 is of a size having an outer perimeter equal to or less than the outer perimeter of the bottom panel 26. As illustrated in FIG. 3, the inner front panel 24 and back panel 28 are folded upward from the bottom panel 26 about the respective first and second fold lines 34, 36 to a generally vertical position, and the inner front side flaps 46, 48 and the back side flaps 54, 56 are folded relative to the inner front panel 24 and back panel 28, respectively, to extend along the lateral sides of the container. Subsequently, the bottom side flaps 50, 52 are folded upward to overlap outer surfaces of the inner front side flaps 46, 48 and back side flaps 54, 56 at a lower portion of the container. Adhesive may be applied between the overlapping flaps 46, 48, 50, 52, 54 and 56 to form joints adhering the flaps 46, 48, 50, 52, 54 and 56 to one another at the locations that the bottom side flaps 50, 52 overlap the inner front side flaps 46, 48 and the back side flaps 54, 56 to form a bottom portion 86 of the container 8, see FIG. 3.

Figure 4:
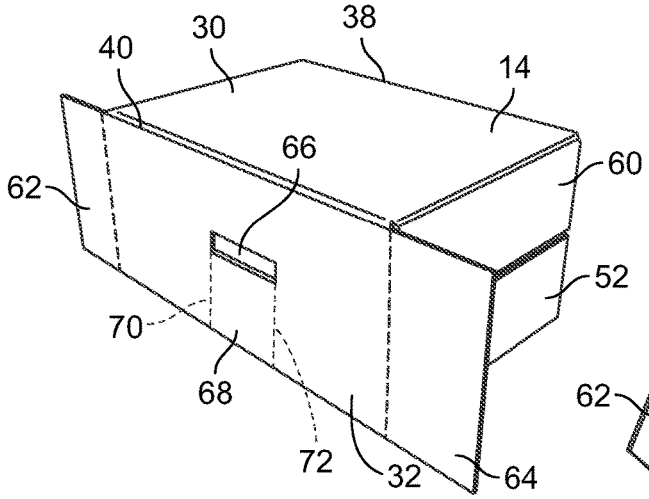
FIG. 4 is a perspective view of a step in the wraparound folding operation prior to a final flap folding operation.

As illustrated in FIG. 4, the top flap 30 is folded about the third fold line 38 to extend across the top of the product 78, and the outer front panel 32 is folded about the fourth fold line 40 to extend down in overlapping relationship across the inner front panel 24, placing the opening 66 in alignment with the recess 76. The outer front side flaps 62, 64 are folded to overlap front portions of the respective top side flaps 58, 60 and bottom side flaps 50, 52, see FIG. 5, and a joint, e.g., adhesive joint, is formed adhering the outer front side flaps 62, 64 to outer surfaces of the top side flaps 58, 60. It should be noted that the overlapped area between the outer front side flaps 62, 64 and outer surfaces of the bottom side flaps 50, 52 is without a joint adhering the respective flaps 62, 64 and 50, 52 together. That is, the outer front side flaps 62, 64 remain movable without attachment to the bottom side flaps 50, 52 in the completed container 8 for shipping the product 78. The completed container 8 is retained closed by a clip of tape 79, see FIG. 5, such as packaging tape, extending across a portion of the separable panel portion 68 and a portion of the bottom panel 26.

The assembled container 8 comprises a box that can be opened as a clamshell, including a lid portion 84 that is pivotally connected to the base portion 86 at the third fold line 38. The base portion 86 is defined by the inner front panel 24 and inner front side flaps 46, 48, the bottom panel 26 and bottom side flaps 50, 52, and the back panel 28 and back side flaps 54, 56, see FIG. 6. The inner front side flaps 46, 48 and back side flaps 54, 56 are located inward of the bottom side flaps 50, 52, and are preferably attached to the bottom side flaps 50, 52 with an adhesive, such as glue, to define the base portion 86.

Figure 6:
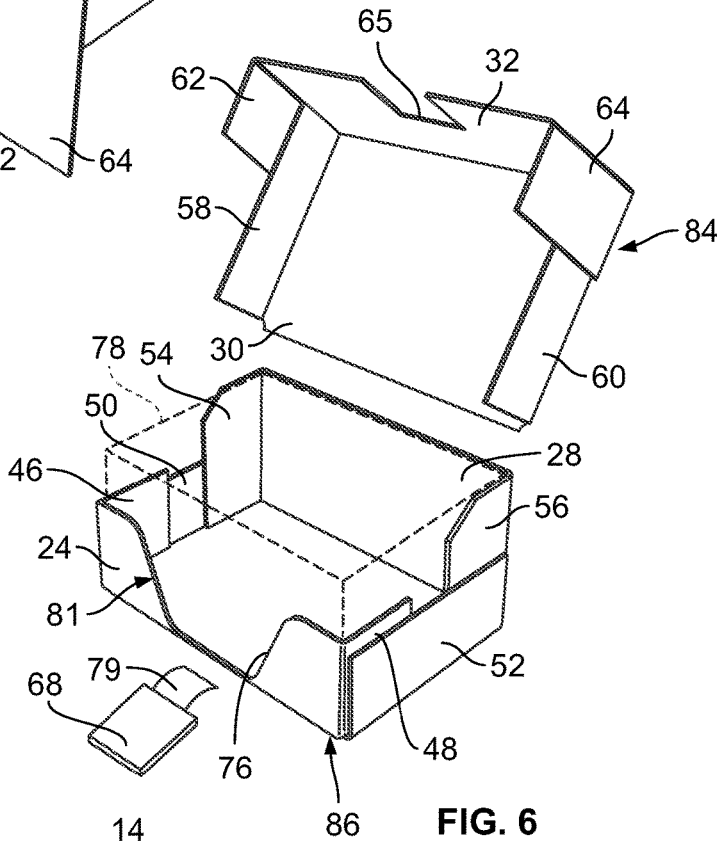
FIG. 6 is a perspective view illustrating reconfiguration of the container of FIG. 5 to form a display container.

The lid portion 84 is defined by the top panel 30 and top side flaps 58, 60, and by the outer front panel 32 and outer front side flaps 62, 64, see FIG. 6. Further, as a result in part of the unique folding sequence described above, the outer front side flaps 62, 64 are located outward of the top side flaps 58, 60, and are preferably attached to the top side flaps 58, 60 with an adhesive, such as glue, to define the lid portion 84. The lid portion 84 is unattached, e.g., without glue or other adhesive, to the lateral sides of the base portion 86 and is free to pivot relative to the base portion 86 when the joint adhering the outer front panel 32 to the bottom panel 26 is released, as described below.

The container 8 can be converted to a display case comprising the base portion 86 and enclosed product 78 by removing the lid portion 84. For example, at the point of sale, the separable panel portion 68 can be grasped through the opening 66 and pulled down to separate the separable panel portion 68 from the outer front panel 32 along the separation lines 70, 72, thereby releasing the outer front panel 32 from the taped connection to the bottom panel 26, see FIG. 6. The lid portion 84 can then be pivoted up without releasing any further connection between the lid portion 84 and the base portion 86, such that the exposed surfaces of the base portion 86 are not disrupted or marred by separation from the lid portion 84. Further, the recess 76 exposed by removal of the lid portion 84 forms a display opening 81 on the front of the base portion 86. Subsequently, the lid portion 84 can be separated from the base portion 86 along the separation line defined at the third fold line 38, and the base portion 86 with product 78 may be used as a display at the point of sale.

It should be understood that, although the present description references use of the container 8 at a point of sale, use of the container 8 is not limited to this particular application and may be implemented for other shipping operations.

Figure 7:
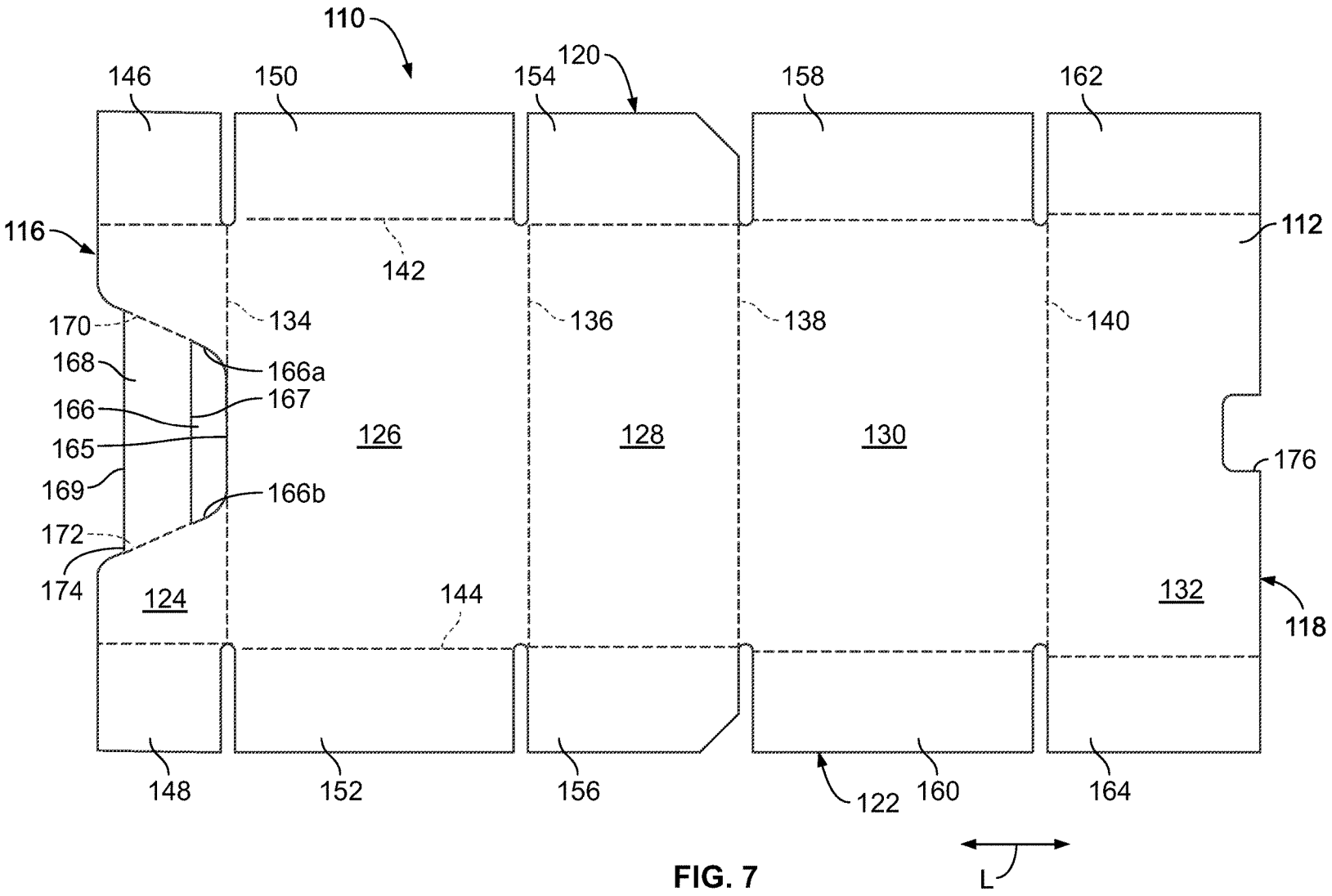
FIG. 7 is a plan view of an alternative configuration of a blank for forming a container.
Figure 9:
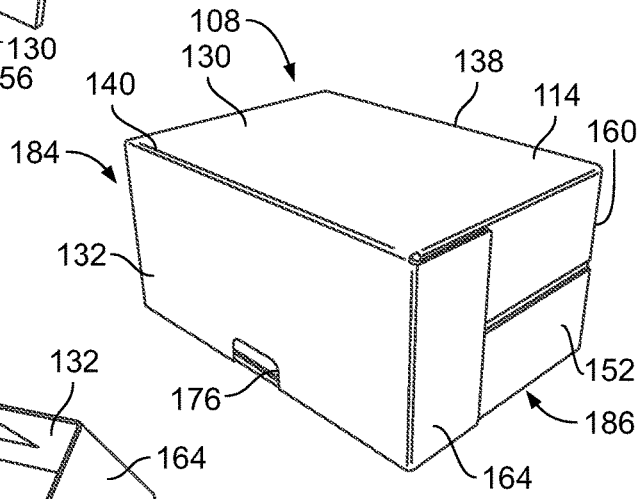
FIG. 9 is a perspective view illustrating completion of the wraparound folding operation to form a shipping container, using the blank of FIG. 7.

Referring to FIG. 7, an alternative configuration of a die cut blank 110 is shown for illustrating one or more aspects of the container described herein. In a use of the blank to form a one-piece container 108, see FIG. 9, the blank 110 may be formed of a corrugated cardboard material and may be die cut to the shape shown herein, although other materials and variations of the illustrated shape may be provided within the scope of the container described and claimed herein. The blank 110 illustrated in FIG. 7 is a planar piece of material in which an inner side 112 is shown facing out of the page and an outer side 114, see FIG. 9, is facing an opposite direction from the inner side 112.

As seen in FIG. 7, the blank 110 extends in a longitudinal direction between first and second longitudinal ends, generally designated 116 and 118, respectively, and further extends in a lateral direction between first and second lateral edges, generally designated 120 and 122, respectively. The blank 110 comprises an inner front panel 124, a bottom panel 126, a back panel 128, a top panel 130, and an outer front panel 132 connected in series. The inner front panel 124 is connected to the bottom panel 126 at a first lateral fold line 134, the bottom panel 126 is connected to the back panel 128 at a second lateral fold line 136, the back panel 128 is connected to the top panel 130 at a third lateral fold line 138, and the top panel 130 is connected to the outer front panel 132 at a fourth lateral fold line 140. A longitudinal length of the outer front panel 132, extending in the longitudinal direction L, is substantially equal to a longitudinal length of the back panel 128, and a longitudinal length of the inner front panel 124 is less than the longitudinal length of the outer front panel 132.

The third fold line 138 comprises a separation line that may be defined, for example, by a partial cut through at least one layer of the corrugated material or a cut line interrupted by short sections of bridging (uncut) material. As will be further understood from the description below, the separation line defined at the third fold line 138 forms a structurally weakened line that can permit separation of the top panel 130 from the back panel 128.

The inner front panel 124 includes an elongated opening 166 defined by longitudinally spaced edges 165, 167. The edge 165 coincides with a longitudinal side of the bottom panel 126 and is generally aligned with, e.g., collinear with, the first fold line 134. The edge 167 comprises an inner edge of a separable panel portion 168. The separable panel portion 168 comprises a belly band defined between two laterally spaced separation lines 170, 172 that extend from opposed lateral ends 166*a*, 166*b* of the opening 166 toward the first longitudinal end 116 of the blank 110. The separation lines 170, 172 may be defined, for example, by a partial cut through at least one layer of the corrugated material or a cut line interrupted by short sections of bridging (uncut) material. The separation lines 170, 172 permit separation of the separable panel portion 168 from the inner front panel 124, as described further below.

A first recessed area 174 of the first longitudinal end 116 of blank 110 is defined by an outer edge 169 of the separable panel portion 168. A second recessed area 176 is cut into the outer front panel 132 from the second longitudinal end 118 of the blank 110.

Inner front side flaps 146, 148 are foldably joined to laterally opposed sides of the inner front panel 124 along respective first and second longitudinal fold lines 142, 144. Bottom side flaps 150, 152 are foldably joined to the bottom panel 126 at the respective longitudinal fold lines 142, 144. Back side flaps 154, 156 are foldably joined to the back panel 128 at the respective longitudinal fold lines 142, 144. Top side flaps 158, 160 are foldably joined to the top panel 130 at the respective longitudinal fold lines 142, 144. Outer front side flaps 162, 164 are foldably joined to the outer front panel 132 at the respective longitudinal fold lines 142, 144.

Figure 8:
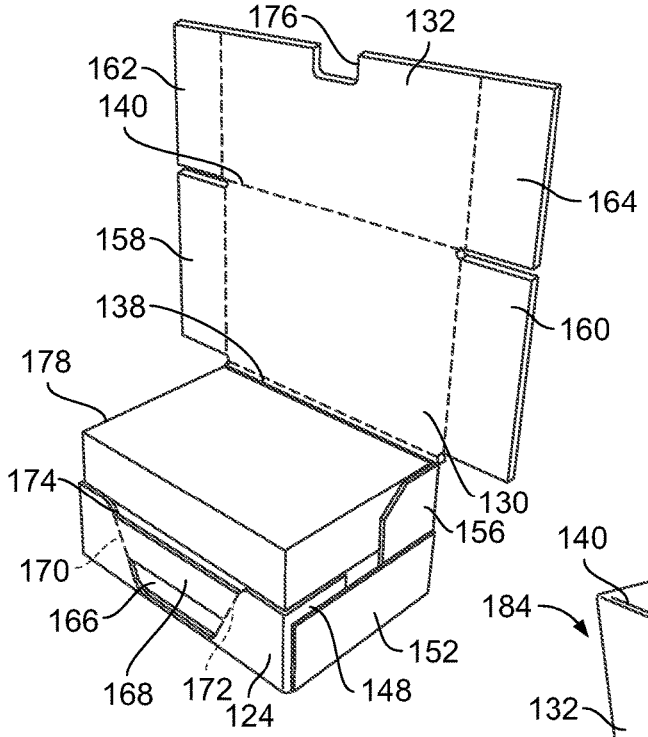
FIG. 8 is a perspective view illustrating partial completion of the wraparound folding operation following formation of a base portion of the container, using the blank of FIG. 7.

A wraparound folding operation using the blank of FIG. 7, may be performed generally following the steps described with reference to FIGS. 2-5 of the previous embodiment, and differing from the previous embodiment in that the lid portion 184, see FIG. 9, of the presently described embodiment is held in place by an adhesive, e.g., glue, rather than the tape clip 79 described for the previous embodiment. Specifically, a product 178 to be packaged in the container 108 of the present embodiment is initially placed on the bottom panel 126 of the blank 110. The product 178 is of a size having an outer perimeter equal to or less than the outer perimeter of the bottom panel 126. The inner front panel 124 and back panel 128 are folded upward from the bottom panel 126 about the respective first and second fold lines 134, 136 to a generally vertical position, and the inner front side flaps 146, 148 and the back side flaps 154, 156 are folded relative to the inner front panel 124 and back panel 128, respectively, to extend along the lateral sides of the container. Subsequently, the bottom side flaps 150, 152 are folded upward to overlap outer surfaces of the inner front side flaps 146, 148 and back side flaps 154, 156 at a lower portion of the container. Adhesive may be applied between the overlapping flaps 146, 148, 150, 152, 154 and 156 to form joints adhering the flaps 146, 148, 150, 152, 154 and 156 to one another at the locations that the bottom side flaps 150, 152 overlap the inner front side flaps 146, 148 and the back side flaps 154, 156 to form a bottom portion 186 of the container 108, see FIG. 8.

The top flap 130 is folded about the third fold line 138 to extend across the top of the product 178, and the outer front panel 132 is folded about the fourth fold line 140 to extend down in overlapping relationship across the inner front panel 124. Prior to positioning the outer front panel 132 over the inner front panel 124, adhesive is preferably applied on an outward facing surface of the separable panel portion 168 laterally inward from the separation lines 170, 172 to form a joint adhering an inner surface of the outer front side panel 132 to an outer surface of the separable panel portion 168. Alternatively, the adhesive may be applied to the inner surface of the outer front side panel 132 for engaging and forming a connection with the separable panel portion 168.

The outer front side flaps 162, 164 are folded to overlap front portions of the respective top side flaps 158, 160 and bottom side flaps 150, 152, see FIG. 9, and a joint, e.g., adhesive joint, is formed adhering the outer front side flaps 162, 164 to outer surfaces of the top side flaps 158, 160. It should be noted that the overlapped area between the outer front side flaps 162, 164 and outer surfaces of the bottom side flaps 150, 152 is without a joint adhering the respective flaps 162, 164 and 150, 152 together. That is, the outer front side flaps 162, 164 remain movable without attachment to the bottom side flaps 150, 152 in the completed container 108 for shipping the product 178.

The assembled container 108, see FIG. 9, comprises a box that can be opened as a clamshell, including a lid portion 184 that is pivotally connected to the base portion 186 at the third fold line 138. The base portion 186 is defined by the inner front panel 124 and inner front side flaps 146, 148, the bottom panel 126 and bottom side flaps 150, 152, and the back panel 128 and back side flaps 154, 156. The inner front side flaps 146, 148 and back side flaps 154, 156 are located inward of the bottom side flaps 150, 152, and are preferably attached to the bottom side flaps 150, 152 with an adhesive, such as glue, to define the base portion 186.

The lid portion 184 is defined by the top panel 130 and top side flaps 158, 160, and by the outer front panel 132 and outer front side flaps 162, 164. Further, as a result in part of the unique folding sequence described above, the outer front side flaps 162, 164 are located outward of the top side flaps 158, 160, and are preferably attached to the top side flaps 158, 160 with an adhesive, such as glue, to define the lid portion 184. The lid portion 184 is unattached, e.g., without glue or other adhesive, to the lateral sides of the base portion 186 and is free to pivot relative to the base portion 186 when the joint adhering the outer front panel 132 to the inner front panel 124 is released, as described below.

Figure 10:
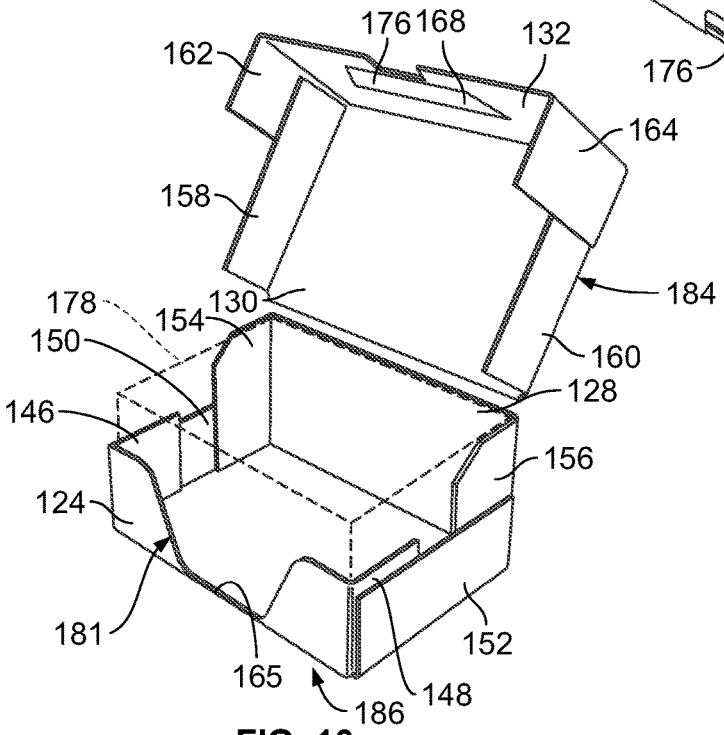
FIG. 10 is a perspective view illustrating reconfiguration of the container of FIG. 9 to form a display container.

The container 108 can be converted to a display case comprising the base portion 186 and enclosed product 178 by removing the lid portion 184. For example, at the point of sale, the second recessed area 176 in the outer front panel 132 permits access to a lower edge of the separable panel portion 168, i.e., at the inner edge 167 of the separable panel portion 168, such that the separable panel portion 168 can be pulled upwardly with the lid portion 184, see FIG. 10. The separable panel portion 168 remains attached to the interior surface of the outer front panel 132 and separates from the inner front panel 124 along the separation lines 170, 172, thereby releasing the outer front panel 132 from the inner front panel 124. The lid portion 184 can then be pivoted up without releasing any further connection between the lid portion 184 and the base portion 186, such that the exposed surfaces of the base portion 186 are not disrupted or marred by separation from the lid portion 184. Further, separation of the separable panel portion 168 from the inner front panel 124 during removal of the lid portion 184 forms a display opening 181 on the front of the base portion 186. Subsequently, the lid portion 184 can be separated from the base portion 186 along the separation line defined at the third fold line 138, and the base portion 186 with product 178 may be used as a display at the point of sale.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipping container convertible to a display container, formed from a one-piece blank of sheet material, the container comprising:

an inner front panel, a bottom panel, a back panel, a top panel, and an outer front panel connected in series at respective first, second, third, and fourth fold lines;

inner front side flaps foldably joined to the inner front panel and back side flaps foldably joined to the back panel, the inner front side flaps and back side flaps extending along lateral sides of the container;

bottom side flaps foldably joined to the bottom panel and overlapping outer surfaces of the inner front side flaps and the back side flaps;

top side flaps foldably joined to the top panel and overlapping an outer surface of at least the back side flaps; and outer front side flaps foldably joined to the outer front panel and overlapping outer surfaces of the top side flaps and the bottom side flaps.

2. The shipping container as set forth in claim 1, including a joint adhering at least one of the bottom side flaps to at least one of the back side flaps and wherein the top side flaps are not adhered to the back side flaps.

3. The shipping container as set forth in claim 1, including a joint adhering at least one of the outer front side flaps to at least one of the top side flaps and wherein the outer front side flaps are not adhered to the bottom side flaps.

4. The shipping container as set forth in claim 1, wherein the third fold line between the top panel and the back panel comprises a separation line.

5. The shipping container as set forth in claim 1, wherein at least one of the inner front panel and the outer front panel includes a separable panel portion defined by a pair of spaced separation lines extending from a lower front edge of the container.

6. The shipping container as set forth in claim 3, wherein one of the inner and outer front panels has an opening having opposed lateral ends and the separation lines extend from the opposed lateral ends of the opening.

7. The shipping container as set forth in claim 6, further including a belly band extending between the separation lines across a portion the inner front panel and including a joint adhering the outer front panel to the belly band.

8. A one-piece blank of sheet material for forming a shipping container convertible to a display container, the blank comprising:

an inner front panel, a bottom panel, a back panel, a top panel, and an outer front panel connected in series at respective first, second, third, and fourth fold lines;

inner front side flaps foldably joined to the inner front panel;

back side flaps foldably joined to the back panel;

bottom side flaps foldably joined to the bottom panel;

top side flaps foldably joined to the top panel;

outer front side flaps foldably joined to the outer front panel; and a first one of the inner and outer front panels defining a first longitudinal end of the blank and including an opening having opposed lateral ends, and a second one of the inner and outer front panels including a recess cut into the second one of the inner and outer panels from a second longitudinal end of the blank.

9. The blank as set forth in claim 8, including a pair of laterally spaced separation lines extending from the lateral ends of the opening toward the first longitudinal end of the blank.

10. The blank as set forth in claim 8, wherein the third fold line between the top panel and the back panel comprises a separation line.

11. The blank as set forth in claim 8, wherein a longitudinal length of the outer front panel is substantially equal to a longitudinal length of the back panel.

12. The blank as set forth in claim 11, wherein a longitudinal length of the inner front panel is less than the longitudinal length of the outer front panel.

13. A method of forming a shipping container convertible to a display container from a one-piece blank of sheet material, the blank comprising an inner front panel, a bottom panel, a back panel, a top panel, and an outer front panel connected in series at respective first, second, third, and fourth fold lines, the method comprising:

folding the inner front panel upward from the bottom panel to a generally vertical position;

folding the back, top and outer front panels about the second, third and fourth fold lines;

folding inner front side flaps joined to the inner front panel to extend along lateral sides of the container;

folding back side flaps joined to the back panel to extend along the lateral sides of the container;

folding bottom side flaps joined to the bottom panel to overlap a lower portion of the inner front side flaps and the back side flaps;

folding top side flaps joined to the top panel to overlap an upper portion of at least the back side flaps; and folding outer front side flaps joined to the outer front panel to overlap front portions of the top side flaps and bottom side flaps.

14. The method as set forth in claim 13, including forming a joint adhering at least one of the bottom side flaps to at least one of the back side flaps, and wherein the top side flaps are not adhered to the back side flaps.

15. The method as set forth in claim 14, including forming a joint adhering at least one of the bottom side flaps to at least one of the inner front side flaps.

16. The method as set forth in claim 13, including a joint adhering at least one of the outer front side flaps to at least one of the top side flaps, and wherein the outer front side flaps are not adhered to the bottom side flaps.

17. The method as set forth in claim 13, including a joint adhering the outer front panel to at least one of the inner front panel and the bottom panel.

18. The method as set forth in claim 13, including a pair of laterally spaced separation lines on at least one of the inner front panel and the outer front panel, and including converting the container to a display container by separating a portion of the at least one panel along the separation lines.

19. The method as set forth in claim 18, wherein the portion of the at least one panel comprises a portion of the inner front panel that is adhered to an inner surface of the outer front panel, and wherein the portion of the inner panel remains adhered to the outer front panel when the portion of the inner front panel is separated along the separation lines.

20. The method as set forth in claim 18, wherein the third fold line between the top panel and the back panel comprises a separation line, and converting the container to a display container includes separating the top panel from the back panel along the third fold line.

* * * * *